US006286593B1

(12) United States Patent
Holtby

(10) Patent No.: US 6,286,593 B1
(45) Date of Patent: Sep. 11, 2001

(54) OILWELL LEAK CONTAINMENT APPARATUS FOR A COMPLETED OILWELL

(76) Inventor: Quinn Holtby, 3611-111B Street, Edmonton, Albertta (CA), T6J-1G9

( * ) Notice: Subject to any disclaimer, the term of this patent is extended or adjusted under 35 U.S.C. 154(b) by 0 days.

(21) Appl. No.: 09/292,094

(22) Filed: Apr. 14, 1999

(30) Foreign Application Priority Data

Jan. 7, 1999 (CA) ..... 2258064

(51) Int. Cl.[7] ..... E21B 19/00

(52) U.S. Cl. ..... 166/81.1; 166/379; 137/312; 137/15

(58) Field of Search ..... 166/81.1, 82.1, 166/84.1, 379; 137/312, 15

(56) References Cited

U.S. PATENT DOCUMENTS

| | | | |
|---|---|---|---|
| 319,693 | 1/1885 | Bond et al. . | |
| 560,986 | 5/1896 | Grow . | |
| 1,507,628 | 9/1924 | Schuyler . | |
| 2,096,882 | 10/1937 | Chernosky | 166/16 |
| 2,137,832 | 11/1938 | Cordes | 166/16 |
| 2,522,444 | 9/1950 | Grable | 166/16 |
| 2,610,690 | 9/1952 | Beatty | 166/16 |
| 2,716,455 | 8/1955 | Jones, Jr. | 166/81 |
| 3,738,436 | 6/1973 | Litchfield et al. | 175/65 |
| 4,450,905 | 5/1984 | Crain | 166/85 |
| 4,949,784 | 8/1990 | Evans | 166/81 |
| 5,121,794 | 6/1992 | Hibdon et al. | 166/81 |
| 5,121,796 | 6/1992 | Wigington, Sr. | 166/379 |
| 5,150,751 | 9/1992 | Burton et al. | 166/81 |
| 5,167,277 | 12/1992 | Evans | 166/81 |
| 5,228,506 | 7/1993 | Pearce | 166/81 |
| 5,343,943 | 9/1994 | Norris et al. | 166/81 |
| 5,377,748 | 1/1995 | Gayaut | 166/81 |
| 5,394,939 | 3/1995 | Walker | 166/81 |
| 5,551,511 | 9/1996 | Holtby | 166/81.1 |
| 5,634,485 | 6/1997 | Holtby | 137/15 |
| 5,937,947 | 8/1999 | Holtby | 166/379 |

*Primary Examiner*—Eileen D. Lillis
*Assistant Examiner*—Alexandra K. Pechhold
(74) *Attorney, Agent, or Firm*—Christensen O'Connor Johnson Kindness PLLC

(57) ABSTRACT

An oilwell leak containment apparatus for a completed oilwell includes a body segmented into two or more segments. Each of segment has a non-mating edge and a mating edge. The non-mating edge has an upstanding containment wall. When the segments are coupled together to form the body the upstanding containment wall extends around a peripheral edge of the body and defines a liquid containment cavity. The mating edge mates with an other segments. Each mating edge has an arcuate portion. When the segments are coupled together to complete the body the arcuate portions form a circular collar. The segments are connected together with quick release couplers. It is preferred that the quick release couplers be positioned within the liquid retaining cavity for ease of access.

14 Claims, 9 Drawing Sheets

OILWELL LEAK CONTAINMENT APPARATUS FOR A COMPLETED OILWELL

FIELD OF THE INVENTION

The present invention relates to an oilwell leak containment apparatus for a completed oilwell.

BACKGROUND OF THE INVENTION

Canadian Patent Application 2,166,265 by Quinn Holtby describes a method and apparatus of preventing fluid leakage from that portion of a completed oilwell known as a "Christmas Trees". The Holtby patent discloses an annular ring which is incorporated as part of the Christmas Tree. Around the annular ring is positioned a catch pan with a drainage opening connected by conduit to a storage container.

While the Holtby reference is a useful apparatus, installation requires disassembly and reassembly of the Christmas Tree.

SUMMARY OF THE INVENTION

What is required is an oilwell leak containment apparatus for a completed oilwell with simplified field installation.

According to the present invention there is provided an oilwell leak containment apparatus for a completed oilwell which includes a body segmented into at least two segments. Each of the at least two segments has a non-mating edge and a mating edge. The non-mating edge has an upstanding containment wall. When the at least two segments are coupled together to form the body the upstanding containment wall extends around a peripheral edge of the body and defines a liquid containment cavity. The mating edge mates with an other of the at least two segments. Each mating edge has an arcuate portion. When the at least two segments are coupled together to complete the body the arcuate portions form a circular collar. A first portion of at least one two part quick release coupler is positioned along the mating edge the one of the at least two segments. A second portion of the at least one two part quick release coupler is positioned along the mating edge of the other of the at least two segments. Coupling of the first portion with the second portion secures the at least two segments together to form the body.

The containment apparatus, as described above, can rapidly be assembled around a Christmas Tree, without having to disassemble and reassemble any portion of the Christmas Tree.

Although beneficial results may be obtained through the containment apparatus, as described above, there is very little room to permit access by personnel, especially as the containment apparatus is positioned lower down on the Christmas Tree. Even more beneficial results may, therefore, be obtained when the at least one two part quick release coupler is positioned within the liquid retaining cavity of the body. Although placing the quick release couplers in a position where they may potentially become submerged in oil has some inherent disadvantages, the advantage of ease of access is believed to outweigh other considerations.

Although beneficial results may be obtained through the use of the containment apparatus, as described above, the connecting of the segments must be done in such a manner as to avoid leakage. Even more beneficial results may, therefore, be obtained when the mating edge of the one of the at least two segments has a projecting tongue and the mating edge of the other of the at least two segments has a tongue receiving groove. To further improve the connection a seal may be positioned within the tongue receiving groove.

Although beneficial results may be obtained through the use of the containment apparatus, as described above, it is preferred that some provision be made to dump accumulated oil from the liquid containment cavity either on a continuous or periodic basis in order to avoid the expense of service with a vacuum truck. Even more beneficial results may, therefore, be provided when the liquid retaining cavity has at least one drainage aperture. It is preferred that at least one catch tray underlies the at least one drainage aperture. Oil is accumulated in the catch tray, which is small enough to be manually dumped on a periodic basis.

Although beneficial results may be obtained through the use of the containment apparatus, as described above, when personnel are servicing the Christmas Tree it is difficult to obtain complete containment due to overspray of oil that can occur. Even more beneficial results may, therefore, be obtained when a plurality of interconnected catch trays underlay the at least one drainage aperture with the interconnected catch trays extending beyond the peripheral edge of the body.

Although beneficial results may be obtained through the use of the containment apparatus, as described above, depending upon the amount of oil that accumulates leakage can occur in the area of the circular collar. Even more beneficial results may, therefore, be obtained when a seal is positioned on the arcuate portions of the at least two segments. When the arcuate portions are joined to form the circular collar, this provides a seal on the circular collar.

Although beneficial results may be obtained through the use of the containment apparatus, as described above, when the body is positioned just above ground level, there is no support from the Christmas tree to hold the body up above the underlying catch trays. Even more beneficial results may, therefore, be obtained when each arcuate portion has a projecting flange, when the at least two segments are coupled to form the body, the projecting flanges form a cylinder that depends from the circular collar.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
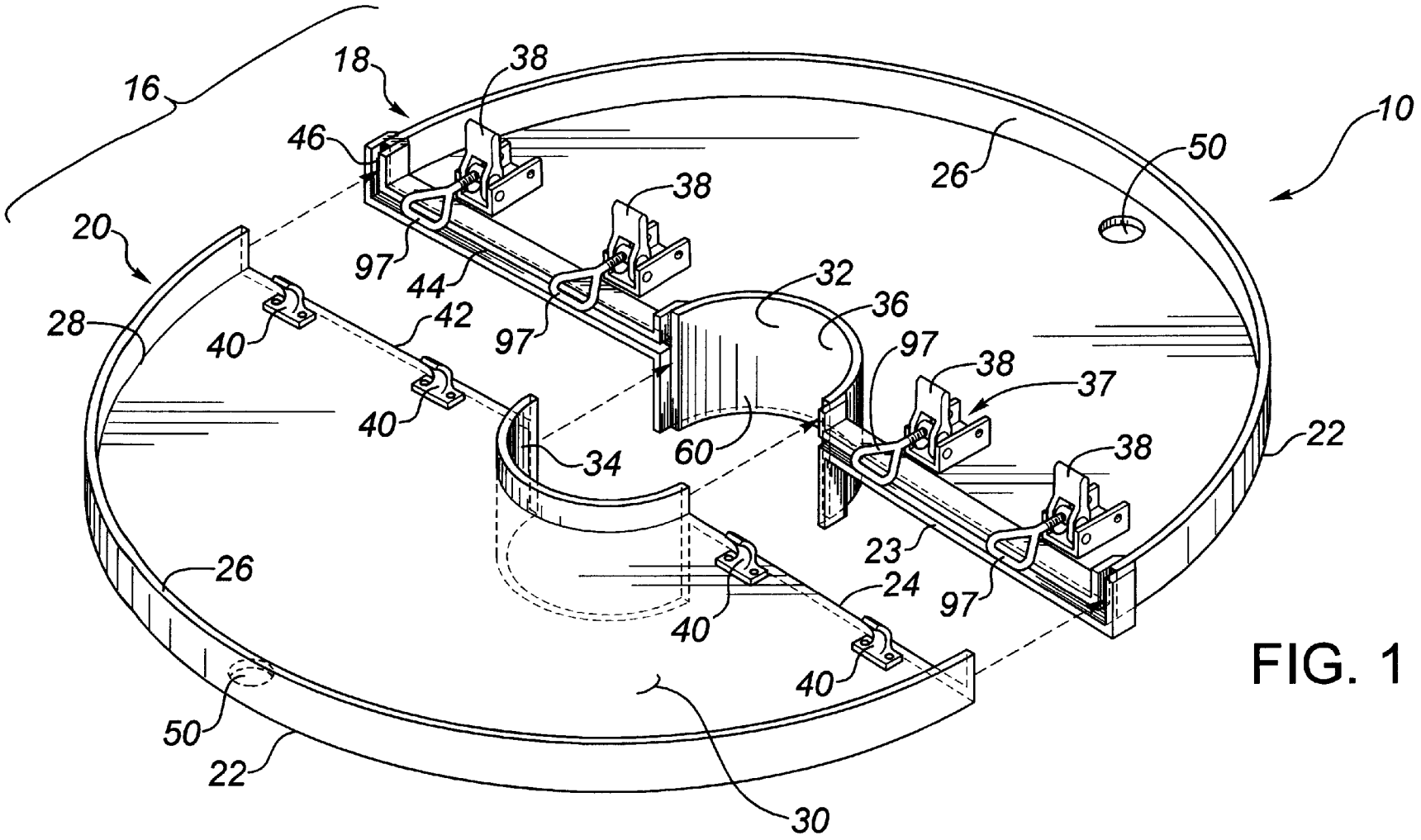
FIG. 1 is a perspective view of a first embodiment of containment apparatus constructed in accordance with the teachings of the present invention.

An oilwell leak containment apparatus for a completed oilwell will now be described with reference to FIGS. 1 through 11. Three embodiments are illustrated. There are minor variations between the embodiments to suit different installation requirements. A first embodiment 10 is illustrated with reference to FIGS. 1 through 3. A second embodiment 12 is illustrated with reference to FIGS. 4 and 5. A third embodiment 14 is illustrated with reference to FIGS. 6 and 7.

Figure 3:
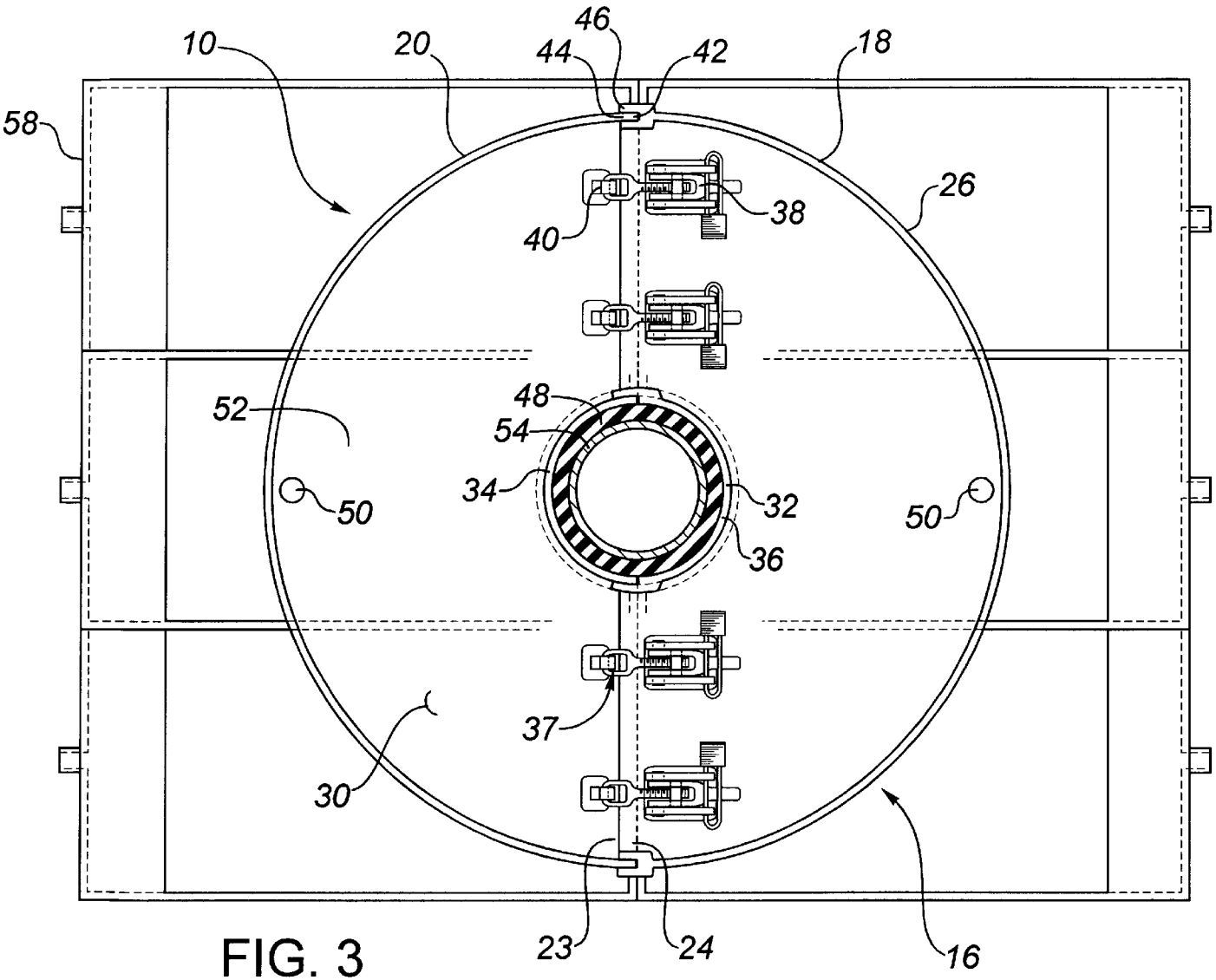
FIG. 3 is a top plan view, in section, of the first embodiment of the containment apparatus illustrated in FIG. 2.
Figure 8:
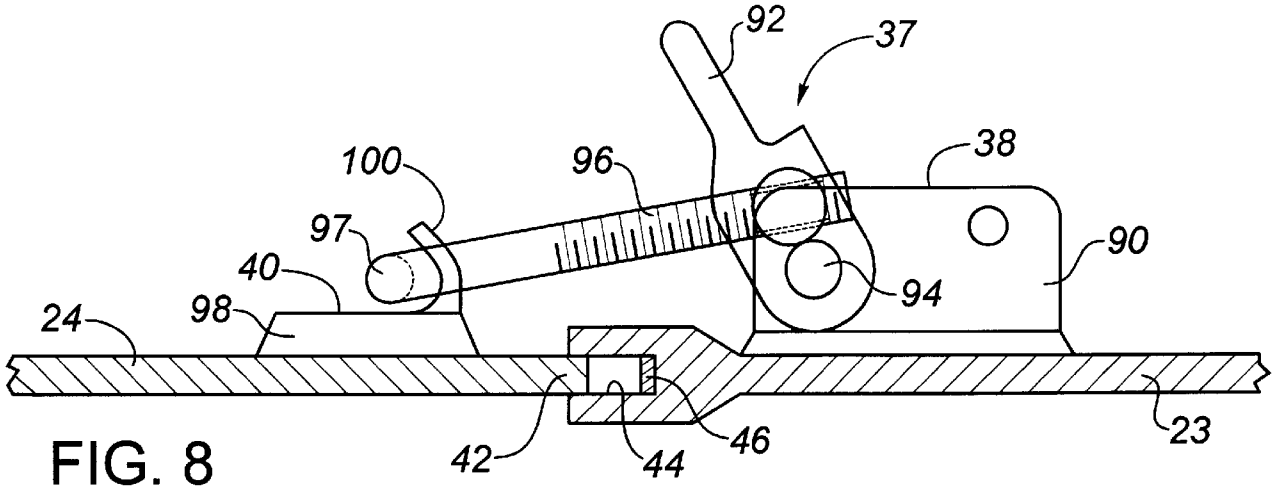
FIG. 8 is a first detailed side elevation view, in section, of a two part coupler used in each embodiment of the containment apparatus.
Figure 9:
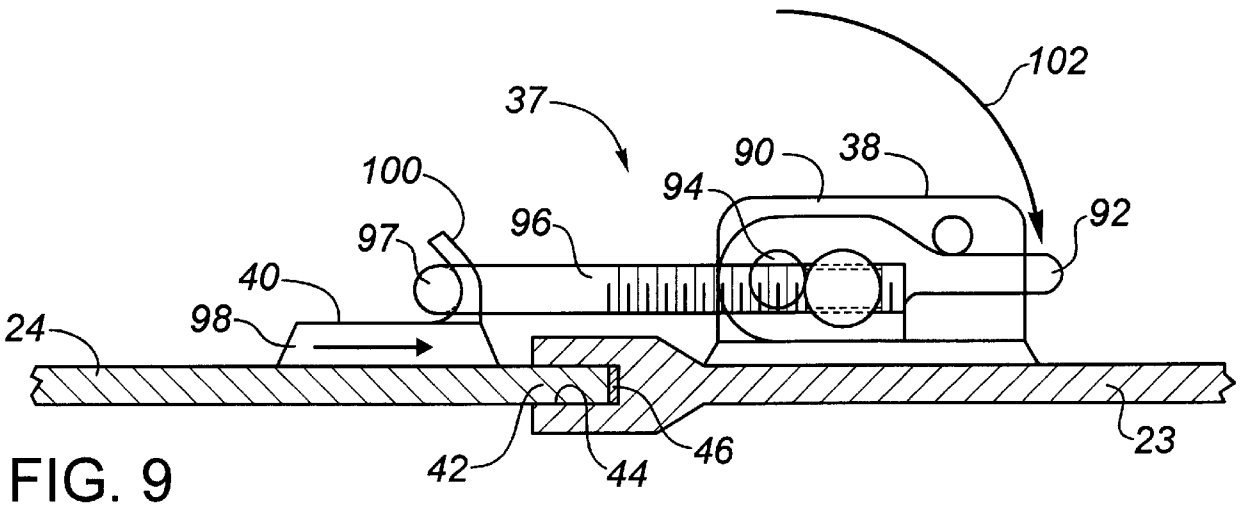
FIG. 9 is a second detailed side elevation view, in section, of a two part coupler used in each embodiment of the containment apparatus.

Referring to FIG. 1, first embodiment 10 consists of a body 16 segmented into a first segment 18 and a second segment 20. Although only two segments are illustrated, it will be appreciated that body 16 could have three or more segments once the underlying teachings of the invention are understood. Each of first segment 18 and second segment 20 has a non-mating edge 22. First segment 18 has a first mating edge 23 and second segment 20 has a second mating edge 24. Non-mating edge 22 has an upstanding containment wall 26. Referring to FIG. 3, when first segment 18 and second segment 20 are coupled together to form body 16, upstanding containment wall 26 extends around a peripheral edge 28 of body 16 and defines a liquid containment cavity 30. Referring to FIG. 1, first mating edge 23 has a first arcuate portion 32 and second mating edge 24 has a second arcuate portion 34. Referring to FIG. 3, when first mating edge 23 mates with second mating edge 24 and first segment 18 and second segment 20 are thereby coupled together to complete body 16, first arcuate portion 32 and second arcuate portion 34 form a circular collar 36. Referring to FIG. 1, several two part quick release couplers are provided, which are generally identified by reference numeral 37. A first portion 38 of each two part quick release coupler 37 is along first mating edge 23. A second portion 40 of each two part quick release coupler 37 is along second mating edge 24. Referring to FIG. 3, both first portion 38 and second portion 40 of two part quick release couplers 37 are positioned within liquid retaining cavity 30 of body 16. Liquid retaining cavity 30 has at least one drainage aperture 50. * Referring to FIG. 8, Second mating edge 24 forms a projecting tongue 42 and first mating edge 23 has a tongue receiving groove 44. A first seal 46 is positioned within tongue receiving groove 44. When projecting tongue 42 is inserted into tongue receiving groove 44 first seal 46 provides a liquid seal between first mating edge 23 and second mating edge 24. Referring to FIGS. 8 and 9, first portion 38 has a fixed member 90 rigidly attached to first segment 18, a lever 92 pivotally attached to fixed member 90 at a position 94 and a latching member 96 having an eyelet 97. Eyelet 97 is best shown in FIG. 1. Second portion 40 has a base 98 rigidly attached to second segment 20 and a hook 100. Referring to FIG. 8, when first segment 18 and segment 20 are to be coupled, eyelet 97 is over hook 100 when lever 92 is in an unlocked elevated position. Referring to FIG. 9, lever 92 is moved pivotally in a direction shown by arrow 102 to a locked position, thereby causing projecting tongue 42 to deform first seal 46 positioned within tongue receiving groove 44 to form a liquid seal.

Figure 2:
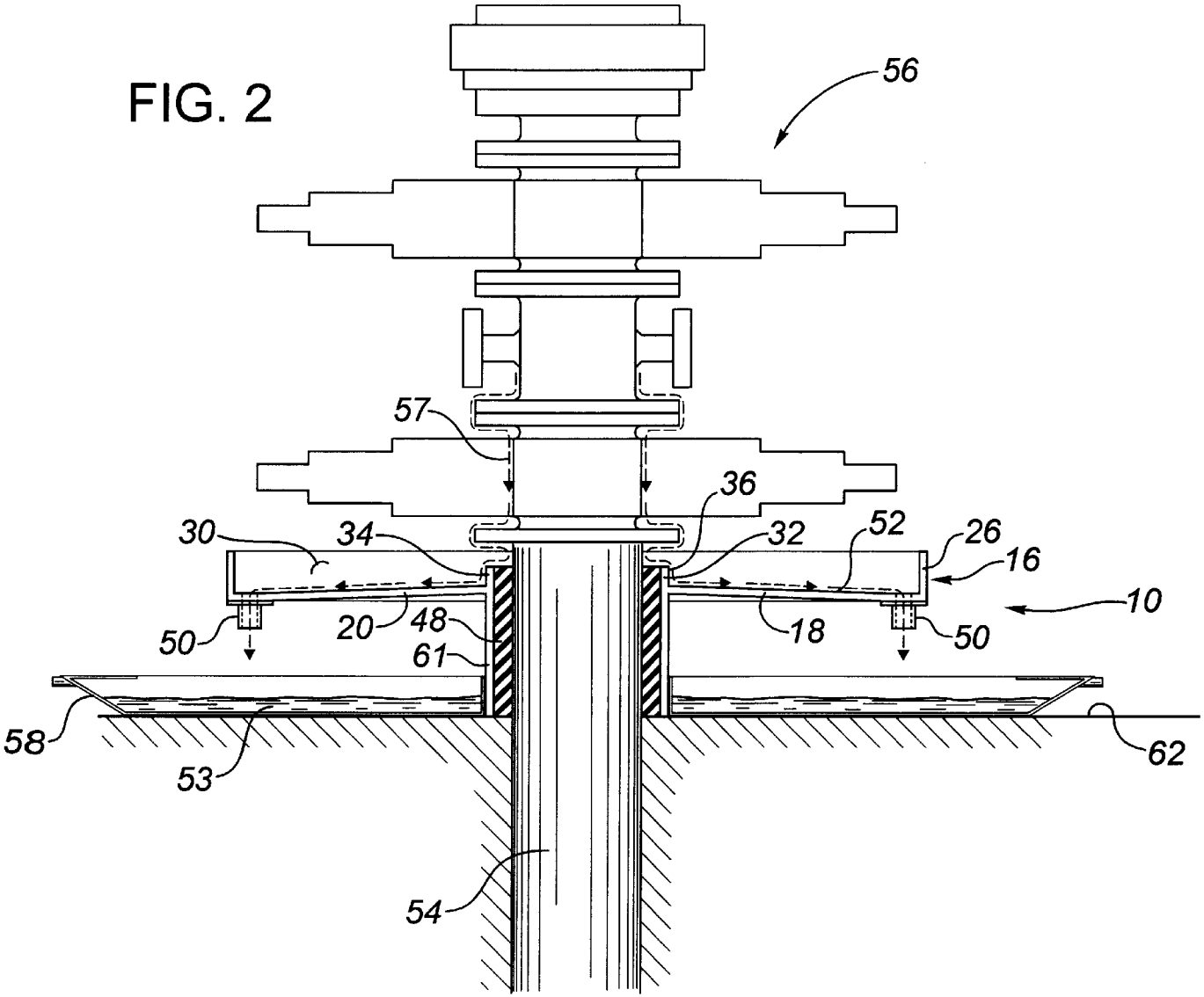
FIG. 2 is a side elevation view, in section, of the first embodiment of the containment apparatus illustrated in FIG. 1, on a Christmas Tree.

Referring to FIG. 2, a surface 52 of body 16 slopes in a slightly downward direction toward upstanding containment wall 26. Referring to FIGS. 2 and 3, a second seal 48 is positioned on first arcuate portion 32 and second arcuate portion 34 thereby forming a seal between circular collar 36 and a pipe 54 forming part of a "Christmas Tree" 56. A plurality of interconnected catch trays 58 underlies drainage apertures 50. Catch trays 58 extend beyond peripheral edge 22 of body 16. The flow of leaked oil from Christmas Tree 56 is indicated by series of arrows 57. Leaked oil 53 runs down Christmas Tree 56 and is contained within liquid retaining cavity 30 of body 16. The leaked oil then runs along sloped surface 52 of body 16 toward one of drain apertures 50, through drain aperture 50 and into one of catch trays 58.

Referring to FIG. 1, in first embodiment 10 each of first arcuate portion 32 and second arcuate portion 34 has a projecting flange 60. Referring to FIG. 2, when first segment 18 and second segment 20 are coupled to form body 16, projecting flanges 60 form a cylinder 61 that depends from circular collar 36. When body 16 is positioned on pipe 54 near a ground surface 62, cylinder 61 holds body 16 up off ground surface 62. This permits catch trays 58 to underlie body 16. When body 16 is positioned at a position higher on "Christmas Tree" 56, as will be described hereinafter, projecting flanges 60 and, consequently, cylinder 61 are not present.

Figure 4:
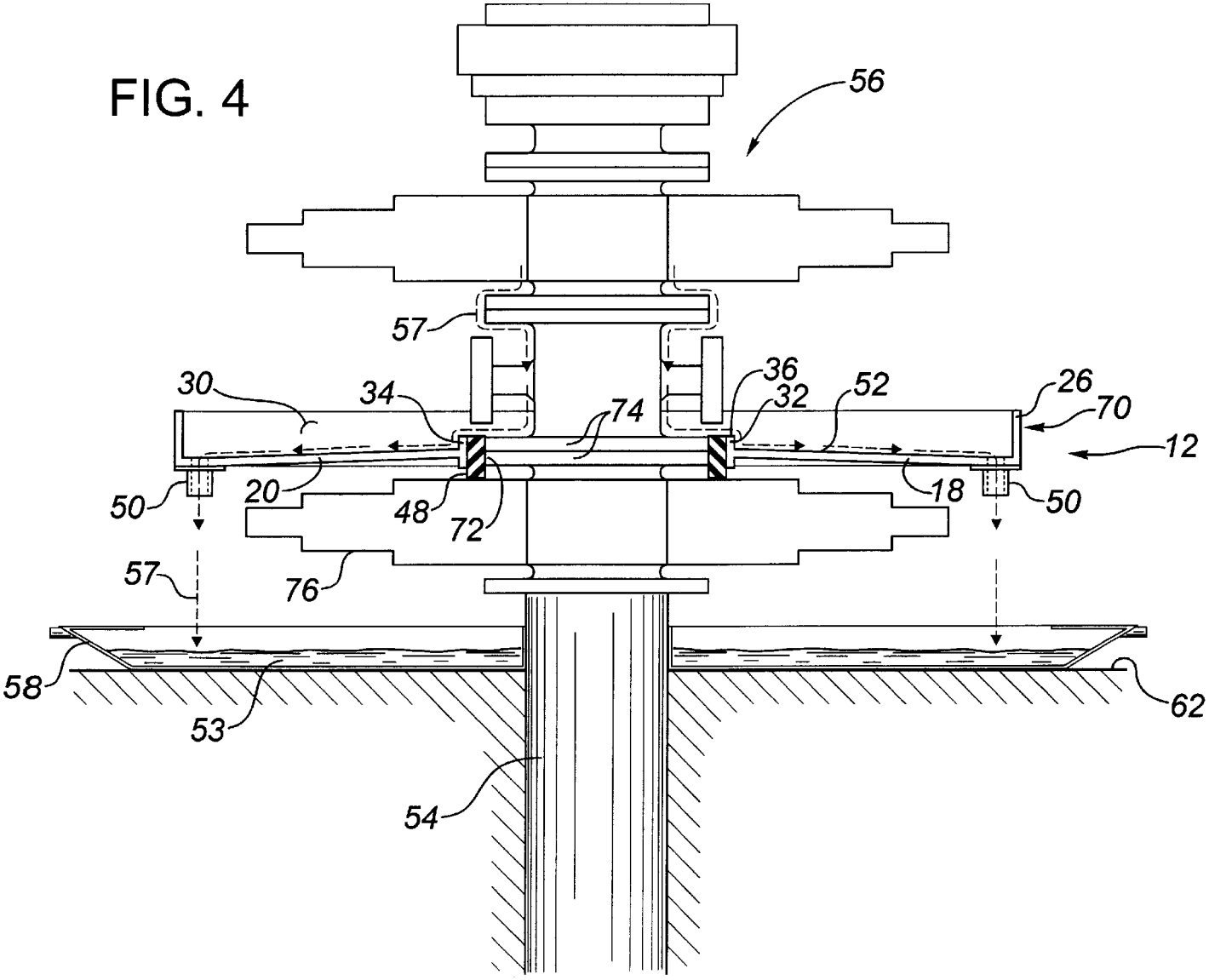
FIG. 4 is a side elevation view, in section, of a second embodiment of the containment apparatus, on a Christmas Tree.
Figure 5:
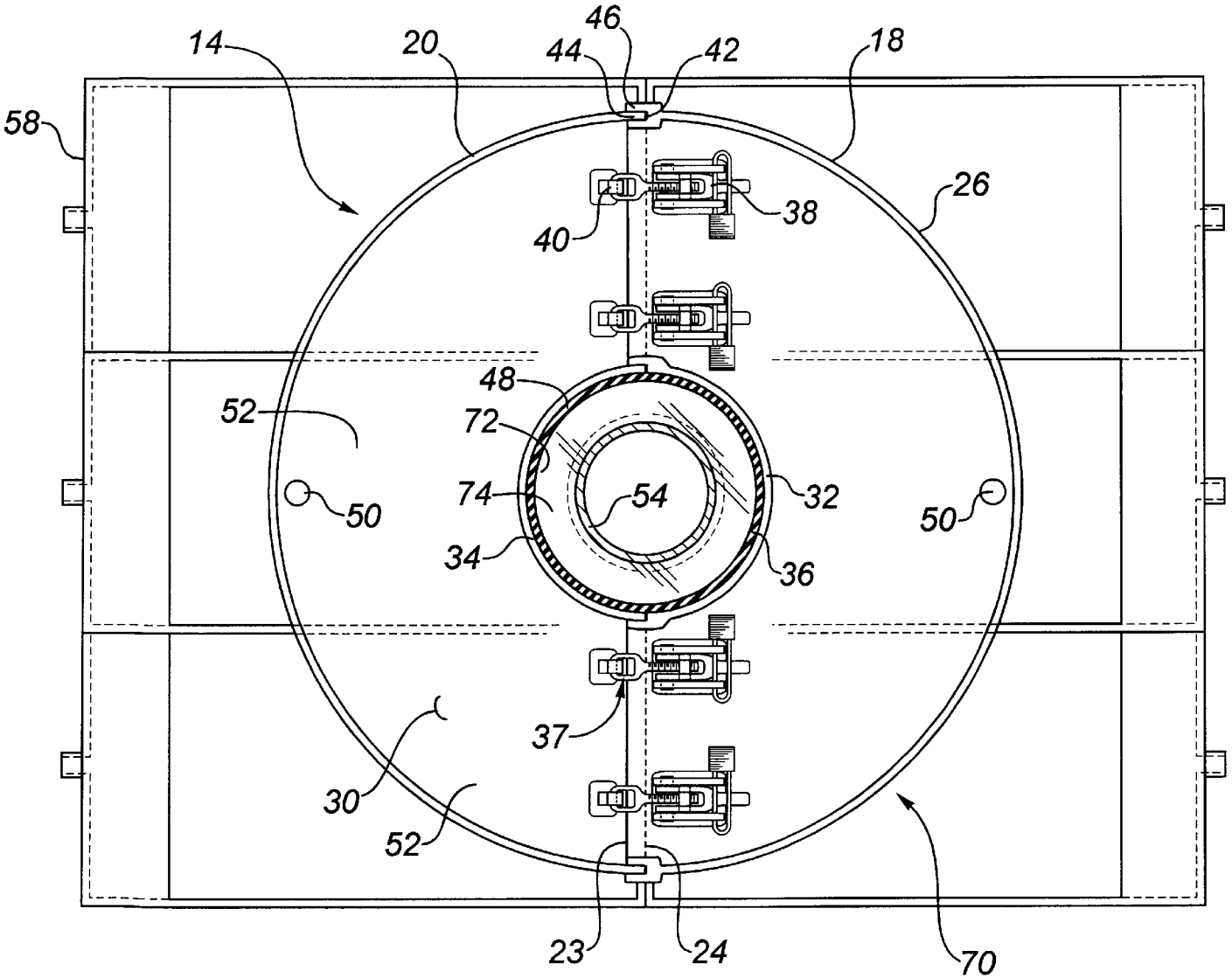
FIG. 5 is a top plan view, in section, of the second embodiment the containment apparatus illustrated in FIG. 4.

Referring to FIGS. 4 and 5, second embodiment 12 is substantially similar to first embodiment 10, but with the following differences. Similar components are hereinafter identified by the same reference numeral. First arcuate portion 32 and second arcuate portion 34 are larger than in first embodiment 10, forming a correspondingly larger circular collar 36. Circular collar 36 is sized so that, when a correspondingly larger second seal 48 is in place, circular collar 36 of a body 70 of second embodiment 12 fits closely about a perimeter 72 of a pair of flanges 74 of "Christmas Tree" 56. When first coupler portion 38 and second coupler portion 40 are coupled second seal 48 provides a tight seal between circular collar 48 and pair of flanges 74. Referring to FIG. 5, a pressure applied to second seal 48 when first coupler portion 38 and second coupler portion 40 are coupled provides a grip by circular collar 36 on pair of flanges 74. Body 70 does not rely solely upon the pressure upon second seal 48 to maintain it in position on "Christmas Tree" 56. Body 70 also rests upon and receives support from one of the radially projecting members 76 of "Christmas Tree" 56.

Figure 6:
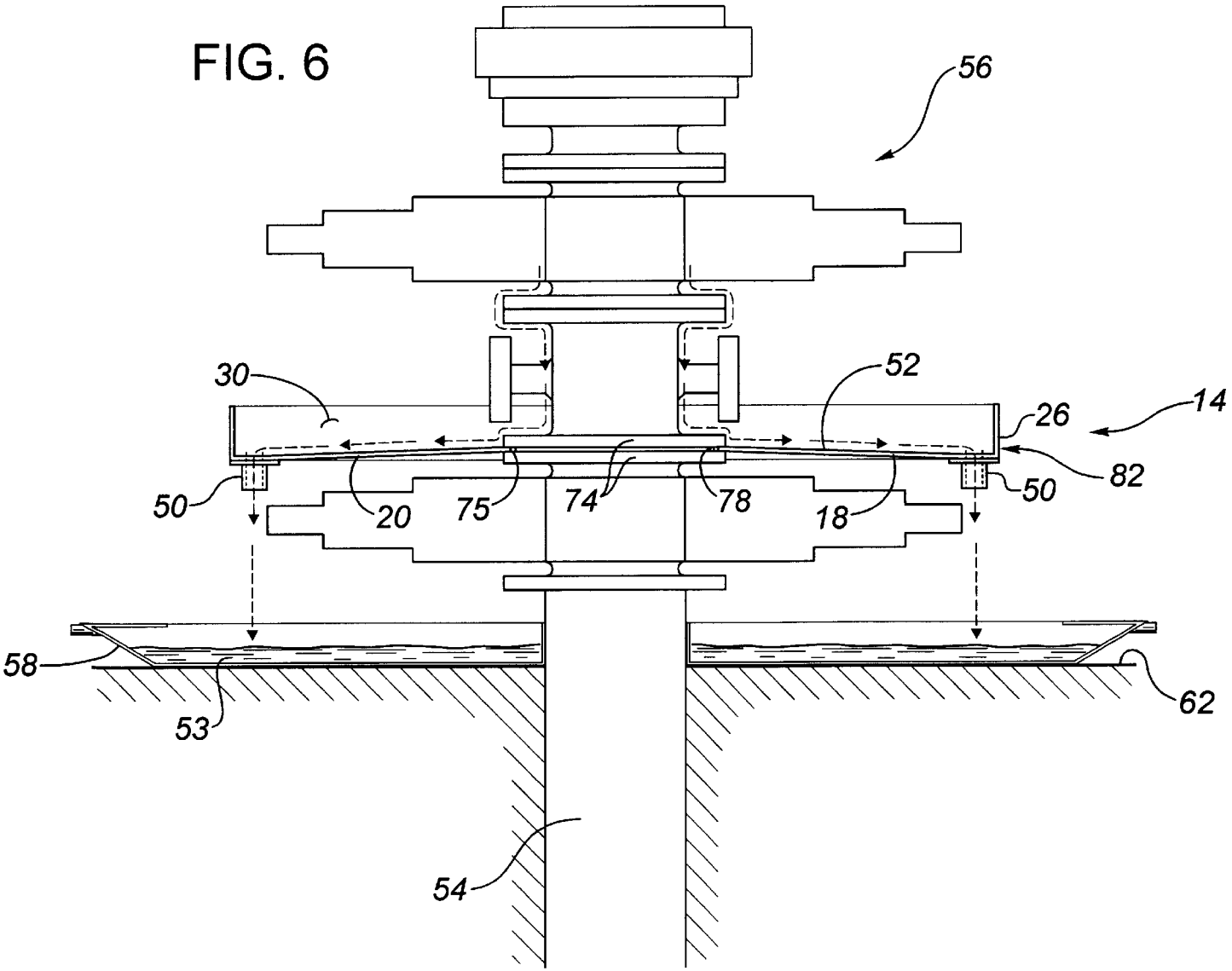
FIG. 6 is a side elevation view, in section, of a third embodiment of the containment apparatus. positioned on a Christmas Tree.
Figure 7:
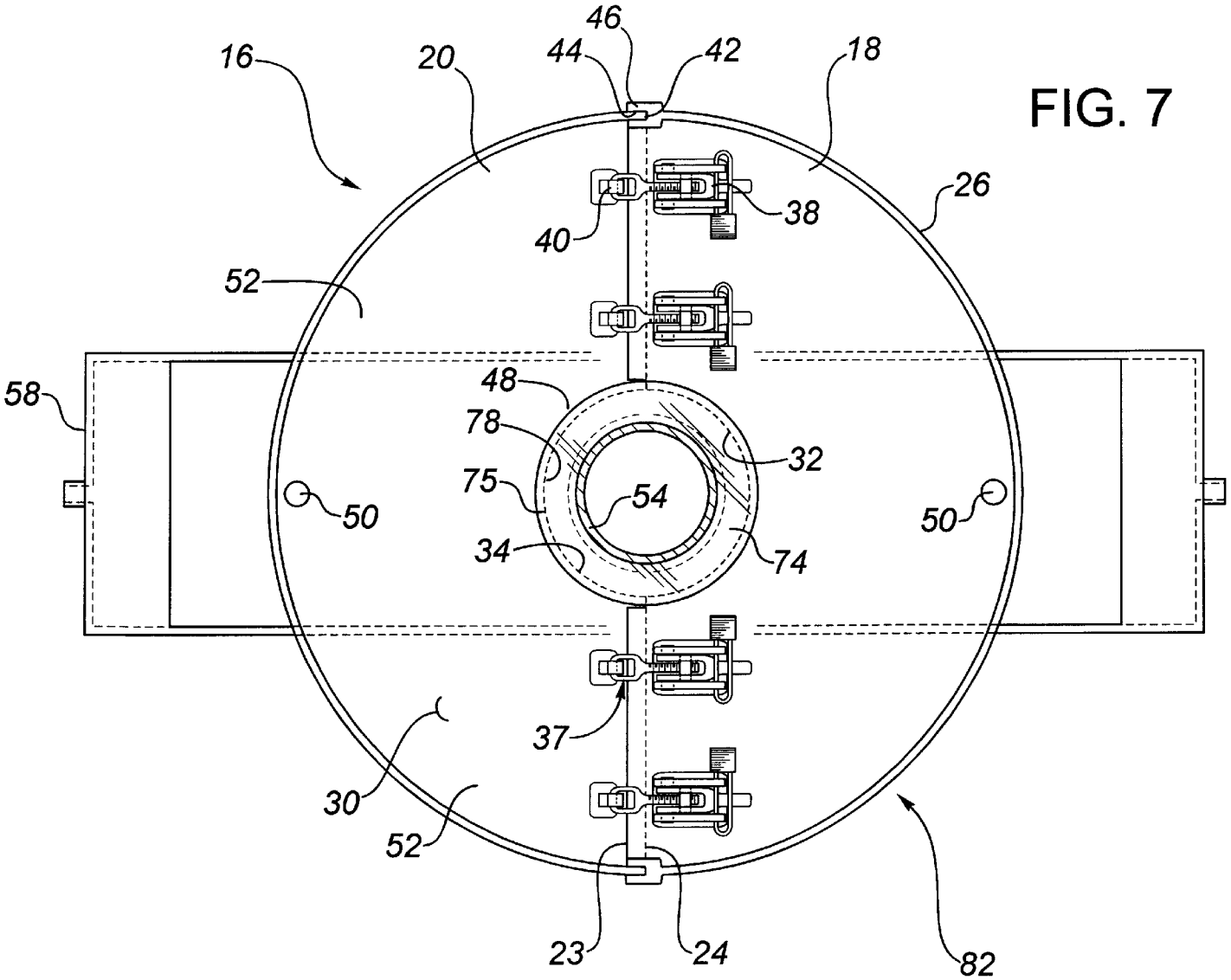
FIG. 7 is a top plan view, in section, of the third embodiment of the containment apparatus illustrated in FIG. 6.
Figure 10:
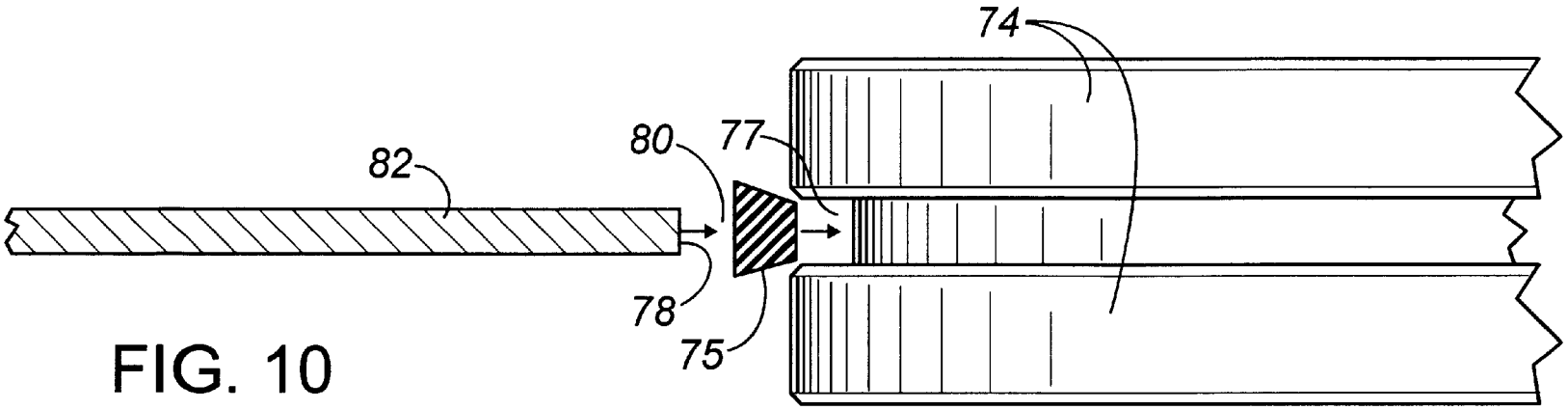
FIG. 10 is a first side elevation view, in section, of a seal used in the third embodiment of containment apparatus illustrated in FIG. 6.
Figure 11:
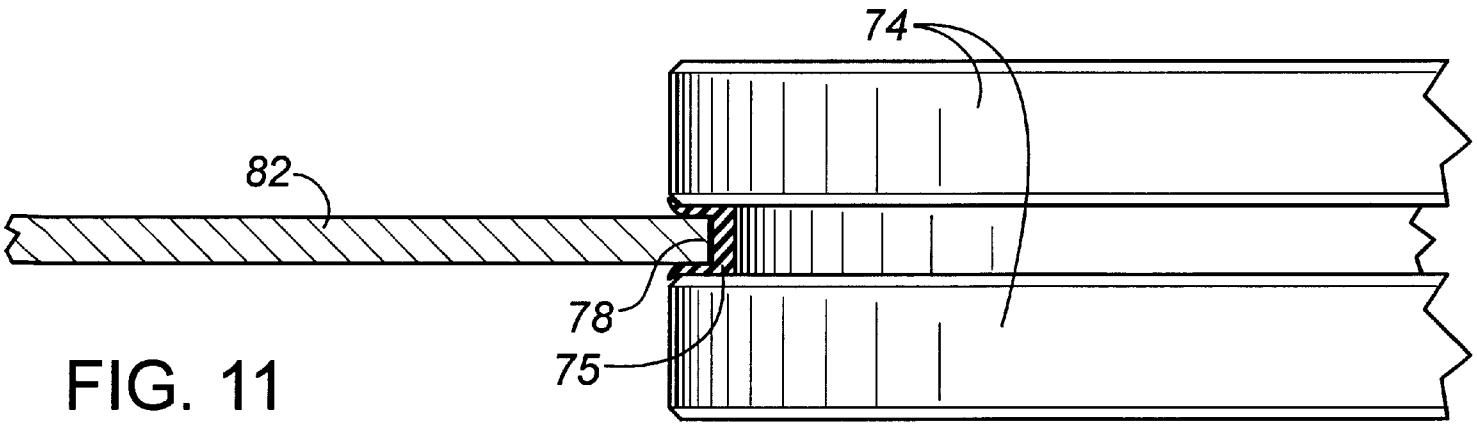
FIG. 11 is a second side elevation view, in section, of a seal used in the third embodiment of containment apparatus illustrated in FIG. 6.

Referring to FIGS. 6 and 7, third embodiment 14 is substantially similar to second embodiment 12, but with the following differences. For ease of reference, similar components are hereinafter identified by the same reference numeral. First arcuate portion 32 of first mating edge 23 and second arcuate portion 34 of second mating edge 24 together define a periphery 78 of a circular aperture 80 when first segment 18 and second segment 20 are coupled to form a body 82. Circular aperture 80 does not have either a raised section or arcuate flanges to form a collar. Periphery 78 has a diameter less than a diameter of pair of flanges 74. Referring to FIG. 10, a third seal 75 is positioned within a groove 77 at the periphery of pair of flanges 74. Referring to FIG. 11, when first segment 18 and second segment 20 are coupled, pressure is applied to third seal 75 forcing said third seal 75 into groove 77 and forming a liquid seal between flanges 74 and body 82. Body 82 is thereby securely supported by flanges 74.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An oilwell leak containment apparatus for a completed oilwell, comprising:

a shallow tray-form body segmented into at least two segments, each of the at least two segments having a non-mating edge and a mating edge, the non-mating edge having an upstanding containment wall, when the at least two segments are coupled together to form the body the upstanding containment wall extending around a peripheral edge of the body and defining a liquid containment cavity, the mating edge mates with an other of the at least two segments, each mating edge having an arcuate portion, when the at least two segments are coupled together to complete the body the arcuate portions forming a circular collar;

at least one of the two segments having a drainage aperture; and couplers positioned within the liquid containment cavity for clamping the mating edges together.

2. The apparatus as defined in claim 1, wherein the couplers positioned within the liquid containment cavity of the body include:

a first portion of at least one two part quick release coupler along the mating edge the one of the at least two segments;

a second portion of the at least one two part quick release coupler along the mating edge of the other of the at least two segments, such that coupling of the first portion with the second portion secure the at least two segments together to form the body.

3. The apparatus as defined in claim 1, wherein the mating edge of the one of the at least two segments has a projecting tongue and the mating edge of the other of the at least two segments has a tongue receiving groove.

4. The apparatus as defined in claim 3, wherein a seal is positioned within the tongue receiving groove.

5. The apparatus as defined in claim 1, wherein at least one catch tray underlies the drainage aperture.

6. The apparatus as defined in claim 1, wherein a plurality of interconnected catch trays underlay the drainage aperture, the catch trays extending beyond the peripheral edge of the body.

7. The apparatus as defined in claim 1, wherein a seal is positioned on the arcuate portions of the at least two segments.

8. The apparatus as defined in claim 1, wherein each arcuate portion has a projecting flange, when the at least two segments are coupled to form the body, the projecting flanges forming a cylinder that depends from the circular collar.

9. An oilwell leak containment apparatus for a completed oilwell, comprising, in combination:

an assemblage of components forming a Christmas tree secured to a wellhead;

a body segmented into at least two segments, each of the at least two segments having a non-mating edge and a mating edge, the non-mating edge having an upstanding containment wall, when the at least two segments are coupled together to form the body the upstanding containment wall extending around a peripheral edge of the body and defining a liquid containment cavity, the mating edge mates with an other of the at least two segments, each mating edge having an arcuate portion, when the at least two segments are coupled together to complete the body the arcuate portions forming a circular collar around the christmas tree;

couplers positioned within the liquid containment cavity of the body for clamping the mating edges together;

the mating edge of the one of the at least two segments having a projecting tongue and the mating edge of the other of the at least two segments has a tongue receiving groove, with a seal positioned within the tongue receiving groove; and at least one of the segments forming the liquid containment cavity having a drainage aperture.

10. The apparatus as defined in claim 9, wherein a plurality of interconnected catch trays underlay the at least one drainage aperture, the catch trays extending beyond the peripheral edge of the body.

11. The apparatus as defined in claim 9, wherein a seal is positioned on the arcuate portions of the at least two segments.

12. The apparatus as defined in claim 9, wherein each arcuate portion has a projecting flange, when the at least two segments are coupled to form the body the projecting flanges forming a cylinder that depends from the circular collar.

13. An oilwell leak containment apparatus for a completed oilwell, comprising, in combination:

an assemblage of components forming a Christmas tree secured to a wellheads;

a body segmented into two segments, each of the two segments having a non-mating edge and a mating edge, the non-mating edge having an upstanding containment wall, when the two segments are coupled together to form the body the upstanding containment wall extending around a peripheral edge of the body and defining a liquid containment cavity, the mating edge mates with an other of the two segments, each mating edge having an arcuate portion, when the two segments are coupled together to complete the body the arcuate portions forming a circular collar around the christmas tree;

several couplers positioned within the liquid containment cavity of the body for clamping the mating edges together, the couplers including:

a first portion of the several two part quick release couplers along the mating edge the one of the two segments;

a second portion of the several two part quick release coupler along the mating edge of the other of the two segments, such that coupling of the first portion with the second portion secures the two segments together to form the body;

the mating edge of the one of the two segments having a projecting tongue and the mating edge of the other of the two segments having a tongue receiving groove;

a seal being positioned within the tongue receiving groove;

a seal is positioned on the arcuate portions of the at least two segments;

at least one of the two segments which form the liquid containment cavity having a drainage aperture;

a plurality of interconnected catch trays underlying the drainage aperture, the catch trays extending beyond the peripheral edge of the body.

14. The apparatus as defined in claim 13, wherein each arcuate portion has a projecting flange, when the at least two segments are coupled to form the body the projecting flanges forming a cylinder that depends from the circular collar.

* * * * *